US009275814B2

(12) United States Patent
Lee

(10) Patent No.: US 9,275,814 B2
(45) Date of Patent: Mar. 1, 2016

(54) MAGNETIC CONTACTOR

(71) Applicant: LSIS CO., LTD., Anyang-si, Gyeonggi-do (KR)

(72) Inventor: Ho Jun Lee, Cheongju-si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 0 days.

(21) Appl. No.: 14/447,469

(22) Filed: Jul. 30, 2014

(65) Prior Publication Data

US 2015/0109713 A1 Apr. 23, 2015

(30) Foreign Application Priority Data

Oct. 18, 2013 (KR) ..... 10-2013-0124776

(51) Int. Cl.

| | |
|---|---|
| ***H01H 50/02*** | (2006.01) |
| ***H01H 47/10*** | (2006.01) |
| ***H01H 50/54*** | (2006.01) |
| ***H01H 71/46*** | (2006.01) |
| ***H01H 47/22*** | (2006.01) |
| ***H01H 50/18*** | (2006.01) |
| ***H01H 50/36*** | (2006.01) |

(Continued)

(52) U.S. Cl.

CPC ..... *H01H 50/021* (2013.01); *H01H 47/10* (2013.01); *H01H 47/22* (2013.01); *H01H 50/18* (2013.01); *H01H 50/36* (2013.01); *H01H 50/541* (2013.01); *H01H 50/543* (2013.01); *H01H 50/545* (2013.01); *H01H 50/546* (2013.01); *H01H 50/56* (2013.01); *H01H 50/60* (2013.01); *H01H 71/46* (2013.01); *H01H 2235/01* (2013.01)

(58) Field of Classification Search

CPC ..... H01H 50/021; H01H 47/22; H01H 50/60; H01H 50/36; H01H 50/18; H01H 50/56; H01H 2235/01

See application file for complete search history.

(56) References Cited

U.S. PATENT DOCUMENTS 1,817,431 A * 8/1931 Andersen ..... 361/194
4,345,225 A * 8/1982 Lemmer ..... 335/132

(Continued)

FOREIGN PATENT DOCUMENTS

CN 102623251 8/2012
DE 10-2009-038671 3/2011

(Continued)

OTHER PUBLICATIONS

European Patent Office Application Serial No. 14179433.9, Search Report dated Mar. 18, 2015, 10 pages.

(Continued)

*Primary Examiner* — Mohamad Musleh

(74) *Attorney, Agent, or Firm* — Lee, Hong, Degerman, Kang & Waimey

(57) ABSTRACT

Disclosed is a magnetic contactor. The magnetic contactor includes a frame, a holder, a movable core, a bobbin, a fixed core coupled to a side of the bobbin and configured to absorb the movable core with a magnetic force, an elastic member provided between the holder and the bobbin, a b-contact switch configured to sense a closing completion time of the movable contact by using a mechanical mechanism relationship with the movable core, an electronic circuit part configured to receive a sensing signal from the b-contact switch and limit a current applied to the coil, and a switch manipulation member provided at one end of the movable core and configured to operate the b-contact switch.

9 Claims, 8 Drawing Sheets

(51) Int. Cl.
*H01H 50/56* (2006.01)
*H01H 50/60* (2006.01)

(56) References Cited

U.S. PATENT DOCUMENTS

| | | | | | |
|---|---|---|---|---|---|
| 4,481,555 | A | | 11/1984 | Yoshida et al. | |
| 4,642,725 | A | * | 2/1987 | Vincent et al. | 361/154 |
| 4,705,341 | A | * | 11/1987 | Schmiedel et al. | 439/544 |
| 4,720,763 | A | * | 1/1988 | Bauer | 361/154 |
| 4,947,146 | A | * | 8/1990 | Ichimura et al. | 335/131 |
| 5,168,418 | A | | 12/1992 | Hurley et al. | |
| 2002/0105771 | A1 | | 8/2002 | Simms et al. | |
| 2004/0027776 | A1 | * | 2/2004 | Uotome et al. | 361/160 |
| 2012/0188044 | A1 | | 7/2012 | Song | |

FOREIGN PATENT DOCUMENTS

| | | |
|---|---|---|
| EP | 0122291 | 10/1984 |
| EP | 0509824 | 10/1992 |
| EP | 2482292 | 8/2012 |
| EP | 2608241 | 6/2013 |
| GB | 877036 | 9/1961 |
| JP | 54-162853 | 5/1978 |
| JP | 03-101028 | 4/1991 |
| JP | 05-135675 | 6/1993 |
| JP | 09-055139 | 2/1997 |
| JP | 2009-009813 | 1/2009 |
| JP | 2009-158159 | 7/2009 |
| JP | 2012-156135 | 8/2012 |
| KR | 10-0505438 | 7/2005 |
| KR | 10-2009-0085979 | 8/2009 |
| KR | 10-2012-0005595 | 8/2012 |

OTHER PUBLICATIONS

Korean Intellectual Property Office Application Serial No. 10-2013-0124776, Notice of Allowance dated May 21, 2015, 2 pages.

Korean Intellectual Property Office Application Serial No. 10-2013-0124776, Office Action dated Dec. 10, 2014, 4 pages.

Japan Patent Office Application Serial No. 2014-165773, Office Action dated Jun. 9, 2015, 4 pages.

* cited by examiner

MAGNETIC CONTACTOR

CROSS-REFERENCE TO RELATED APPLICATION

Pursuant to 35 U.S.C. §119(a), this application claims the benefit of earlier filing date and right of priority to Korean Application No. 10-2013-0124776, filed on Oct. 18, 2013, the contents of which are hereby incorporated by reference herein in its entirety.

BACKGROUND OF THE DISCLOSURE

1. Field of the Disclosure

The present disclosure relates to a magnetic contactor that prevents an overcurrent from flowing in a coil by using a b-contact switch.

2. Background of the Disclosure

Generally, a magnetic contactor is a device that switches power (a current) flowing in a main circuit by using the electromagnet principle.

In the magnetic contactor, a closing operation is normally performed in only a case where when the magnetic contactor is closed, namely, when a movable contact of main power is moved to and contacts a fixed contact, a transient current flows in a coil, and then, when a closed state is maintained, namely, when a contacted state of the contact is maintained, a normal current flows in the coil. Therefore, the coil is not damaged by the rising of a temperature when the insertion is maintained.

As described above, in order to solve a problem such as a coil being damaged, a b-contact switch included in a product limits a current applied to the coil so that an overcurrent does not flow in the coil in a closing operation of the magnetic contactor.

FIG. 1A is a circuit diagram of an electronic circuit part applied to a magnetic contactor. In the electronic circuit part of the magnetic contactor, a plurality of electronic elements for controlling a current flowing a coil L are mounted on a printed circuit board (PCB).

The electronic circuit part includes a plurality of external power input terminals P1 and P2 which receive external power, a bridge diode B/D which is disposed between the external power input terminals P1 and P2 and the coil L, a b-contact switch SW which is disposed between the external power input terminals P1 and P2 and the bridge diode B/D, and a capacitor C that is connected to both ends of the b-contact switch SW.

In this case, the coil L is provided in a state of being wound around a bobbin that is an internal element of a product. When external power is alternating current (AC) power, the bridge diode B/D converts the AC power into direct current (DC) power.

To describe a flow path of the external power, the magnetic contactor is closed, and when the external power (an external current) is applied through the external power input terminals P1 and P2, the applied external current flows to the coil L through the b-contact switch SW having low impedance to drive the coil L. The b-contact switch SW is switched off simultaneously with the driving of the coil L, and thus, the applied external current flows to the coil L through the capacitor C having high impedance. Therefore, an overcurrent which is applied to the coil L when a closed state of the magnetic contactor is maintained is limited.

FIG. 1B is an exploded assembly view of a b-contact switch and a holder in a lower frame of a prior art magnetic contactor. In FIG. 1B, a holder 20 is movably equipped in an upper frame, and a bobbin is provided in a lower frame 12.

When external power is applied to a coil which is wound around the bobbin, a fixed core is changed to an electromagnet by a magnetic field which is generated around the coil, and thus, a movable core is absorbed into a fixed core by a magnetic force. At this time, the holder 20 coupled to an upper portion of the movable core is lowered, and presses a b-contact switch SW to switch off the b-contact switch SW.

However, in the prior art magnetic contactor, when a size of a product is large, the b-contact switch SW may be disposed at each of left and right sides (sides in a width direction) of the product. However, when a product is miniaturized, a free space in which the b-contact switch SW is provided is sufficient, and for this reason, it is difficult to miniaturize the product. Also, when the b-contact switch SW cannot be disposed at each of left and right sides of a product, it is difficult to implement a normal operation.

SUMMARY OF THE DISCLOSURE

Therefore, an aspect of the detailed description is to provide a magnetic contactor in which when a product is miniaturized, a space which a b-contact switch is provided is secured, and a normal operation of the b-contact switch is realized.

To achieve these and other advantages and in accordance with the purpose of this specification, as embodied and broadly described herein, a magnetic contactor includes a frame, a holder, a movable core, a bobbin, a fixed core, an elastic member, a b-contact switch, an electronic circuit part, and a switch manipulation member.

The frame may include a fixed contact which is fixed to and provided in the frame.

The holder may include a movable contact.

The movable contact may be movably provided in the frame.

The movable contact may contact the fixed contact.

The movable core may be coupled to the holder to interoperate with the holder.

The bobbin may be fixed to and provided in the frame, and configured to include a coil.

The fixed core may be coupled to a side of the bobbin, magnetized, and configured to absorb the movable core with a magnetic force.

The elastic member may be provided between the holder and the bobbin, and may restore a position of the movable core.

The b-contact switch may be configured to sense a closing completion time of the movable contact by using a mechanical mechanism relationship with the movable core.

The electronic circuit part may be configured to receive a sensing signal from the b-contact switch and limit a current applied to the coil.

The switch manipulation member may be provided at one end of the movable core, and configured to operate the b-contact switch.

In the above-described embodiment of the present invention, a disposed position of the b-contact switch is changed to a lower portion of a product in comparison with the existing product, and thus, a size of the product can be reduced.

Moreover, without operating the b-contact switch by using the existing holder, the movable core is included in the switch manipulation member, and thus, despite the b-contact switch being provided at a lower portion of a product, an operation of the b-contact switch is realized by the switch manipulation member. Accordingly, a product can be miniaturized.

The frame may include a first frame and a second frame.

The first frame may accommodate the holder.

The second frame may be adjacently assembled with the first frame.

The second frame may internally accommodate the bobbin and the fixed core.

The b-contact switch may be provided in the second frame.

The b-contact switch may be contactably disposed within a moving distance range of the switch manipulation member.

The electronic circuit part may be provided at a width-direction side of the bobbin in parallel with a moving direction of the movable core.

The b-contact switch may be disposed at an end of one side of the electronic circuit part and on a moving line of the switch manipulation member.

The switch manipulation member may include a switch manipulation body, a switch manipulation part, and a switch manipulation projection.

The switch manipulation part may be provided to protrude at an end of one side of the switch manipulation body.

The switch manipulation part may be disposed to be separated from the b-contact switch with an interval in a moving direction of the movable core.

The switch manipulation projection may be formed at the switch manipulation part to protrude toward the b-contact switch.

The switch manipulation projection may be formed in an embossed shaped at an end of the switch manipulation part.

According to a first embodiment of the present invention, the holder may include a guide groove formed at one end of the holder.

The movable core may include a support and a supporting pin.

The support may be provided at the switch manipulation part.

The support may include an inserting hole at each of both sides of the support.

The supporting pin may be inserted into the insertion hole to pass through the insertion hole.

Both ends of the supporting pin may be inserted into and coupled to the coupling part of the holder to connect the holder to the support.

According to a second embodiment of the present invention, the holder may include a guide groove formed at one end of the holder.

The movable core may include a support provided at the switch manipulation part.

The support may include a sliding projection which is formed at each of both ends of the support, and may be inserted into and coupled to the guide groove of the holder.

The b-contact switch may include a switch body and a switch operation member.

The switch body may include a movable contact and a fixed contact.

The switch operation member may be provided at one end of the switch body.

The switch operation member may be pressurized by the switch manipulation member.

The switch operation member may switch off the movable contact and fixed contact of the b-contact switch.

The switch operation member may have a strip type in which a length is longer than a width, may be provided at one end of the switch body to be inclined in a hinge structure, and may have elasticity.

A contact terminal having an arc shape may be provided at an end of the switch operation member.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

As described above, in the magnetic contactor according to an embodiment of the present invention, the b-contact switch is disposed at a lower portion of a product, and thus, the product is miniaturized. Also, even without enlarging a size of the product, an operation of the b-contact switch is realized by using the switch manipulation member which is provided in the movable core.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

The present invention relates to a magnetic contactor in which as a product is miniaturized, a space which a b-contact switch is provided is secured in the product, and an operation of the b-contact switch is realized.

Figure 1A:
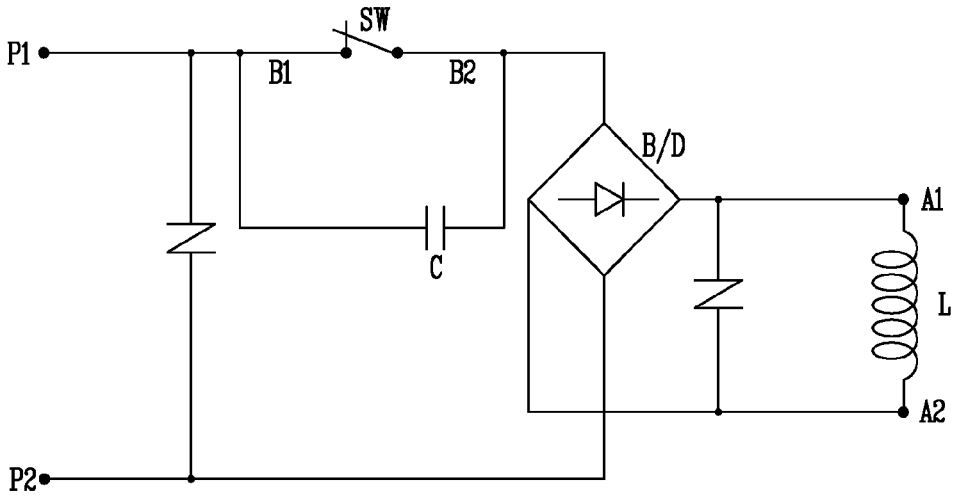
FIG. 1A PRIOR ART
FIG. 1A is a circuit diagram of an electronic circuit part applied to a magnetic contactor.
Figure 1B:
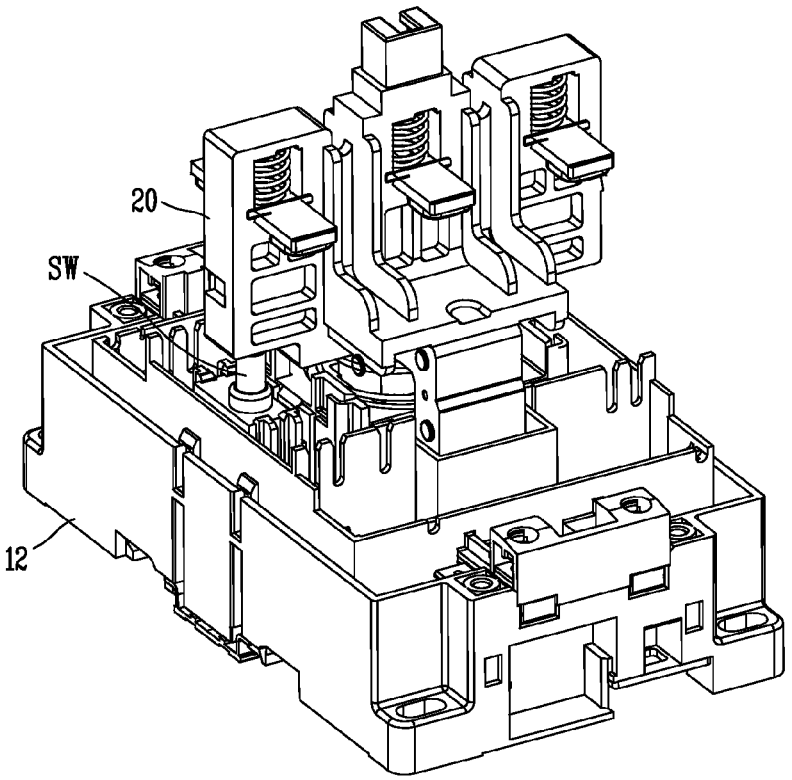
FIG. 1B PRIOR ART
FIG. 1B is a schematic diagram illustrating the inside of a product for describing an operation of a b-contact in a prior art magnetic contactor.
Figure 2:
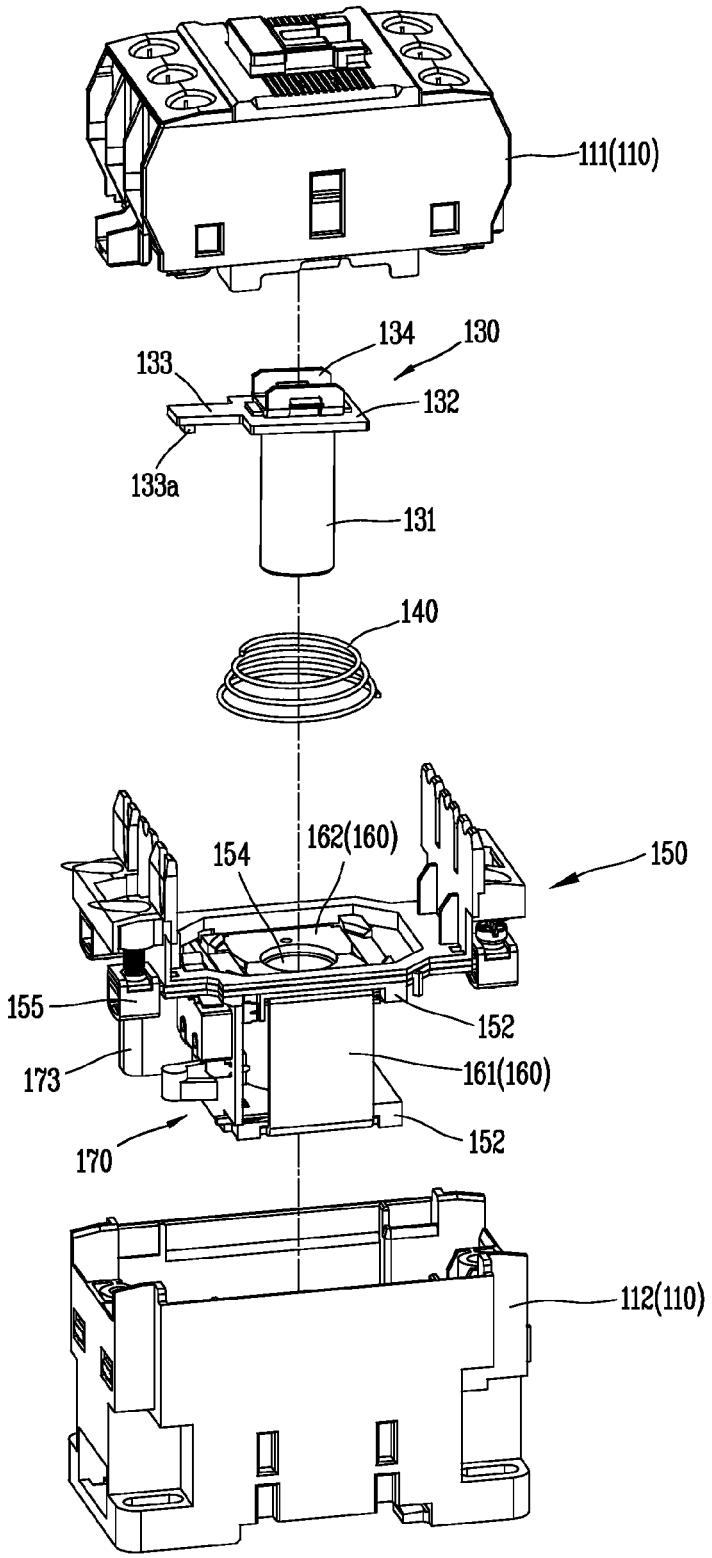
FIG. 2 is a perspective view of a magnetic contactor according to an embodiment of the present invention.

FIG. 2 is a perspective view of a magnetic contactor according to an embodiment of the present invention.

The magnetic contactor according to an embodiment of the present invention includes a frame 110, a holder 120, a movable core 130, an elastic member 140, a bobbin 150, a b-contact switch 172, and an electronic circuit part 170.

The frame 110, for example, includes a first frame 111 and a second frame 112 which are respectively disposed at an upper portion and a lower portion in a moving direction of the movable core 130. The first and second frames 111 and 112 are detachably assembled. An accommodating space is provided in the frame 110, and accommodates the holder 120, the movable core 130, the elastic member 140, the bobbin 150, the b-contact switch 172, and the electronic circuit part 170.

A plurality of fixed contacts 113 are respectively provided in parallel at a power source side and a load side and in the first frame 111. In this case, when a main power is three-phase AC power, the fixed contacts 113 may be disposed at the power source side and the load side to be separated from each other in a width direction of the frame 110 for each of R, S, and T phases.

The holder 120 includes a plurality of movable contacts 123 that are movably provided in a vertical direction in the first frame 111, and is formed in parallel to protrude toward the power source side and the load side. Also, a long side of the holder 120 is disposed in parallel with the width direction of the frame 110.

The movable contacts 123 are elastically supported by an elastic spring, and are respectively disposed on the fixed contacts 113 to be separated from each other.

The movable core 130 is formed in a cylindrical structure, and is insertable into the bobbin 150. Therefore, an internal space occupied by the movable core 130 can be minimized in comparison with a prior art E-shaped movable core 130.

Moreover, the movable core 130 may include a switch manipulation member which is provided at an upper portion, and manipulate the b-contact switch 172.

The switch manipulation member may include a switch manipulation body 132, which has a plate structure, and a switch manipulation part 133 which is provided to protrude in one side direction from the switch manipulation body 132. The switch manipulation member may mechanically contact the b-contact switch 172.

The movable core 130 is coupled to and supported by a bottom of the holder 120 by using a support 134. The movable core 130 lowers the movable contact 123 to the fixed contact 112 to contact the movable contact 123 with the fixed contact 112 by using the holder 120.

The bobbin 150 includes a cylindrical bobbin body 151, which is long disposed in a vertical direction, and a plurality of core insertion parts 152 which are respectively disposed at an upper end and lower end of the bobbin body 151 in a radius direction.

The bobbin body 151 has a hollow part 154 which is formed therein. The movable core 130 may be vertically inserted into the bobbin body 151 through the hollow part 154. Also, a coil 156 is wound around the bobbin body 151, and thus, when external power is applied to the coil 156, a magnetic field is generated.

The core insertion part 152 includes an opening which enables the fixed core to be inserted.

A plurality of external power input terminals may be provided at left and right ends of the core insertion part 152 of the bobbin 150, and external power may be applied to the coil 156 through external power input terminals.

The elastic member 140 may be a compression coil spring which is formed in order for a diameter to be reduced progressively closer to an upper direction. An upper end of the compression coil spring elastic-supports the bottom of the holder 120, and a lower end of the compression coil spring is fixed to and supported by an upper end of the bobbin 150.

The fixed core 160 forms a box structure to surround an outer surface of the coil 156 in an axial direction of the cylindrical bobbin body 151. In this case, the fixed core 160 may be separated into first and second fixed cores 161 and 162 in a width direction of the bobbin 150.

The first and second fixed cores 161 and 162 are detachably assembled with the core insertion part 152 at both sides of the bobbin 150 in the width direction, and thus are easy to assemble and maintain. In comparison with a prior art E-shaped fixed core 160, an internal space of a product occupied by the fixed core 160 is minimized, and thus, a free space in which the b-contact switch 172 is provided can be secured at a lower portion (the second frame 112) of the product.

The electronic circuit part 170 includes a PCB 171 which is equipped with various electronic elements, and controls an external source current flowing in the coil 156.

The b-contact switch 172 is included in the PCB 171. When the movable contact 123 is closed, a closing completion time is sensed by a mechanical mechanism with the movable core 130. When the closing completion time is sensed, an internal contact of the b-contact switch 172 is inverted from switch-on to switch-off, whereby a flow direction of a current is changed.

In this case, the b-contact switch 172 may be disposed within a moving distance range of the movable core 130 so as to maintain a mechanical mechanism relationship with the movable core 130, and may operate according to a movement of the movable core 130.

A closing operation of the movable contact 123 denotes that the movable contact 123 moves toward the fixed contact 113, and the closing completion time denotes that the movable contact 123 contacts the fixed contact 113.

Moreover, the capacitor 173 is included in the PCB 171. An external source voltage is dropped simultaneously with an inversion of the b-contact switch 172, and thus, a current applied to the coil 156 is reduced. Therefore, when a closed state of the movable contact 123 is maintained, an overcurrent of the coil 156 is limited.

The closed state of the movable contact being maintained denotes a state in which the movable contact 123 contacts the fixed contact 113.

Here, the PCB 171 may be coupled to width-direction one side of the bobbin 150 to be adjacent to the fixed core 160, and may be equipped in a lower portion of a product, namely, the inside of the second frame 112 by using a free space.

In the prior art, the b-contact switch 172 is disposed at each of left and right sides of a product, and thus, a size of the product is enlarged. However, in an embodiment of the present invention, the b-contact switch 172 is disposed at a lower portion of a product, more particularly, at an upper portion of the PCB which is coupled to the width-direction one side of the bobbin 150 built into the second frame 112. Accordingly, despite a product being miniaturized, a space in which the b-contact switch 172 is provided can be secured.

In the prior art, since the b-contact switch 172 is disposed at a side of a product, the holder 120 may directly press and operate the b-contact switch 172. However, in an embodiment of the present invention, since the b-contact switch 172 is disposed at a lower portion of a product, namely, in the second frame 112, it is impossible for the holder 120 to operate the b-contact switch 172.

Figure 3:
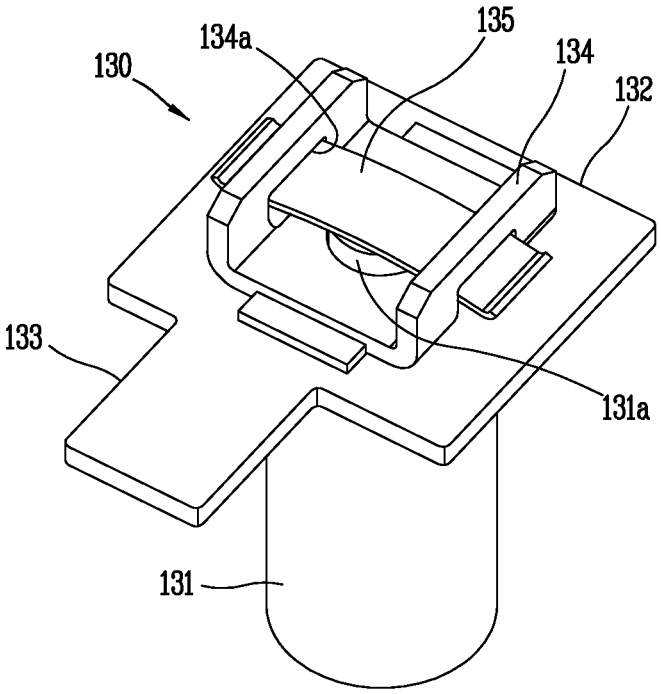
FIG. 3 is a perspective view of a movable core according to a first embodiment of the present invention.
Figure 4:
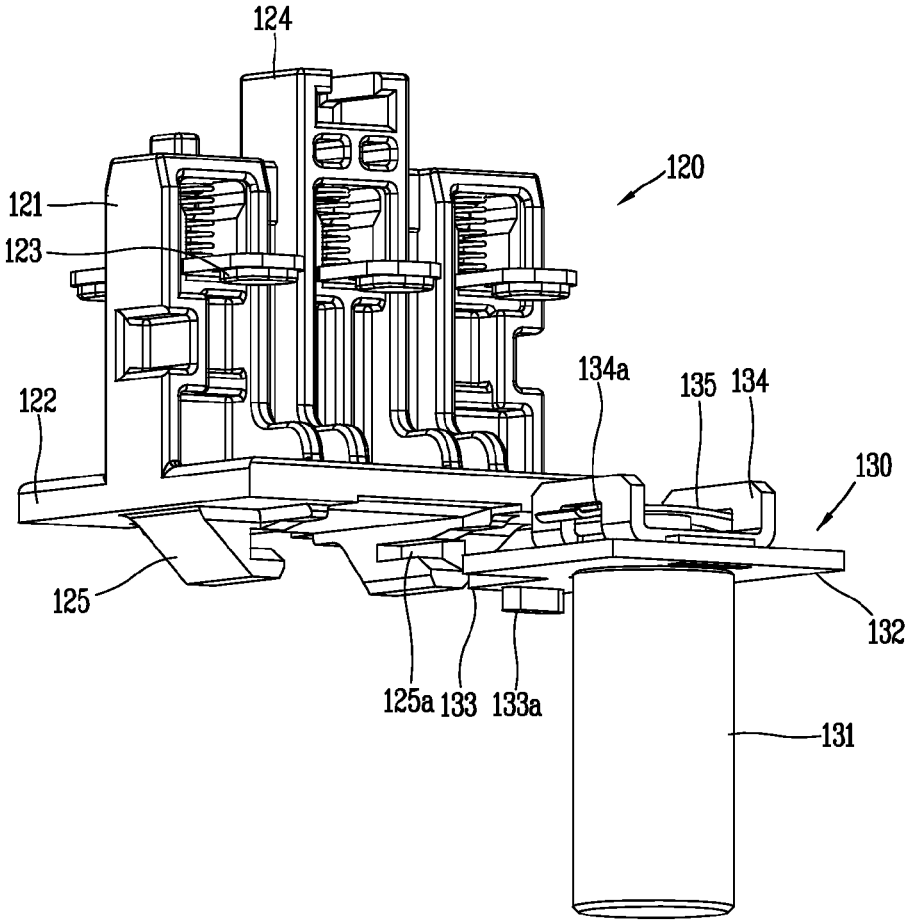
FIG. 4 is a perspective view illustrating a state before the movable core of FIG. 3 is coupled to a holder.
Figure 5:
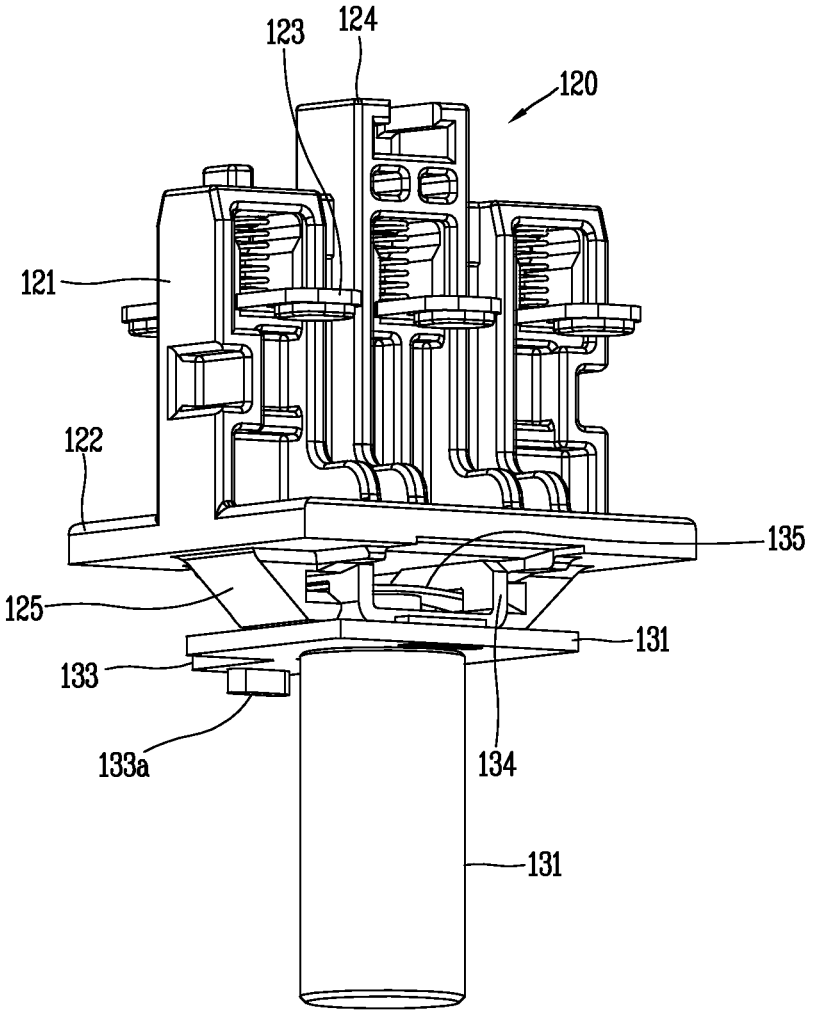
FIG. 5 is a perspective view illustrating a state after the movable core of FIG. 3 is coupled to the holder.
Figure 6:
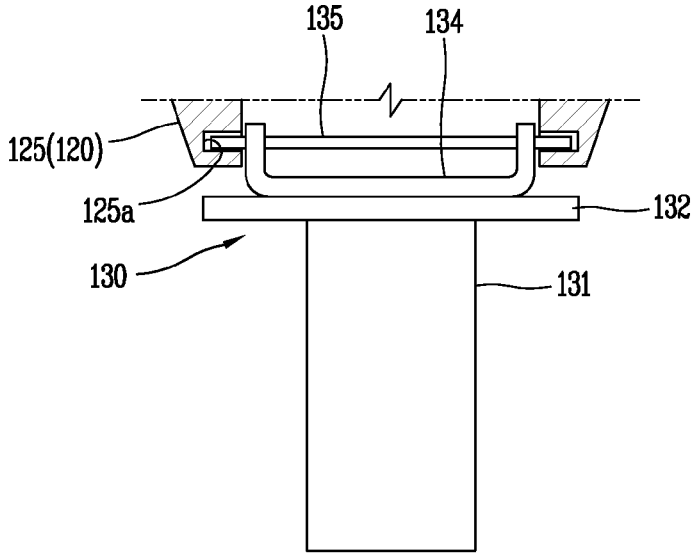
FIG. 6 is a cross-sectional view illustrating a state in which the movable core is coupled to the holder.

FIG. 3 is a perspective view of a movable core 130 according to a first embodiment of the present invention. FIG. 4 is a perspective view illustrating a state before the movable core 130 of FIG. 3 is coupled to a holder 120. FIG. 5 is a perspective view illustrating a state after the movable core 130 of FIG. 3 is coupled to the holder 120. FIG. 6 is a cross-sectional view illustrating a state in which the movable core 130 is coupled to the holder 120.

In an embodiment of the present invention, the movable core 130 may directly operate the b-contact switch 172 by using a mechanical mechanism relationship between the movable core 130 and the b-contact switch 172.

The movable core 130 may include a switch manipulation part 133 which is provided at an upper portion of the movable core 130, and thus, when the movable core 130 is lowered toward the fixed core 160, the b-contact switch 172 may operate according to a contact of the switch manipulation part 133.

Here, the b-contact switch 172 may be disposed within a moving distance range of the switch manipulation part 133, and may contact the switch manipulation part 133.

The movable core 130 may include a cylinder-shaped movable body 131 that is long provided in a vertical direction, a plate-shaped switch manipulation body 132 that is provided at an upper end of the movable body 131, and the switch manipulation part 133 which is provided at one side of the switch manipulation body 132 to protrude.

The switch manipulation body 132 may be manufactured separately from the movable body 131. A connecting shaft 131*a* having a small diameter is provided at an upper end of the movable body 131 to protrude, for fixing the switch manipulation body 132 to the movable body 131.

A connecting hole is formed in the switch manipulation body 132 to pass through the switch manipulation body 132, and the connecting shaft 131*a* goes to an upper portion of the switch manipulation body 132 through the connecting hole.

Moreover, a support 134 may be disposed between the switch manipulation body 132 and the bottom of the holder 120, and may be coupled to the switch manipulation body 132 as one body through the connecting hole 131*a*. A connecting hole is formed in the support 134 to pass through the support 134, and the connecting shaft 131*a* is coupled to the support 134 through the connecting hole. An upper end of the connecting shaft 131*a* may be riveted, and thus, the support 134 and the switch manipulation body 132 may be stacked on and coupled to an upper end of the movable body 131 as one body.

Moreover, an anti-torsion member which is provided at a top of the switch manipulation body 132 may prevent the switch manipulation part 133 of the switch manipulation body 132 from being rotated in the movable core 130.

The support 134 may include a supporting plate, which is stacked on the top of the switch manipulation body 132, and a side plate which is bent toward the holder 120 and at both ends of the supporting plate. In this case, a long hole may be included in the side plate.

A supporting pin 135 may be inserted into the long hole of the support 134, and the support 134 may be connected to the holder 120 through the supporting pin 135.

The supporting pin 135 may have a strip-type plate structure that has a length longer than a width and is thin in thickness, and both ends of the supporting pin 135 may be bent to be rounded.

Moreover, a guide projection 125 is formed at the bottom of the holder 120, and a guide groove 125*a* is formed at an inner surface of the guide projection 125.

In this case, the both ends of the supporting pin 135 are inserted into the guide groove 125*a* of the holder 120, and thus, the supporting pin 135 is coupled to the holder 120 in a slide type in a width direction (a direction from the bottom of the holder 120 to a short side) of the holder 120. Therefore, the support 134 is coupled to the holder 120.

Accordingly, the movable core 130 and the holder 120 may operate as one body. Also, the movable core 130 may be mechanically connected to a movable contact 123 included in the holder 120, and may move the movable contact 123 to a fixed contact 113.

Figure 7:
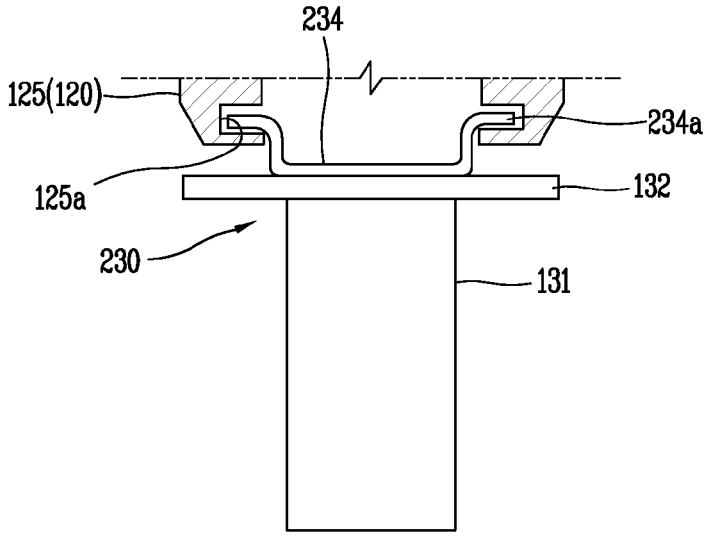
FIG. 7 is a perspective view illustrating a state in which a movable core according to a second embodiment of the present invention is coupled to a holder.
Figure 8:
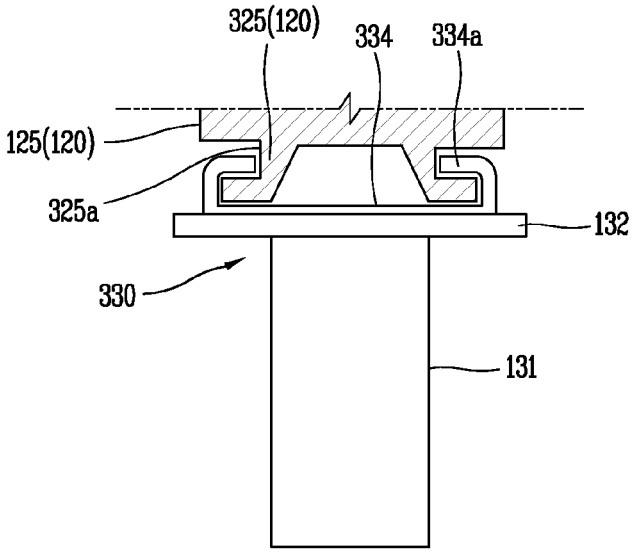
FIG. 8 is a perspective view illustrating a state in which a movable core according to a third embodiment of the present invention is coupled to a holder.

FIG. 7 is a perspective view illustrating a state in which a movable core 230 according to a second embodiment of the present invention is coupled to a holder 120, and FIG. 8 is a perspective view illustrating a state in which a movable core 330 according to a third embodiment of the present invention is coupled to a holder 120.

A support 234 of the movable core 230 according to the second embodiment may not include the supporting pin 135 unlike the first embodiment, and may have a structure in which a sliding projection 234*a* is bent outward from a supporting plate, and a bent portion is inserted into a guide groove 125*a* of the holder 120 in a slide type, whereby the support 234 is coupled to the holder 120.

A support 334 of the movable core 330 according to the third embodiment may not include the supporting pin 135 unlike the first embodiment, and may have a structure in which a sliding projection 334*a* is bent inward from a supporting plate, and a bent portion is inserted into a guide groove 325*a* of the holder 120 in a slide type, whereby the support 334 is coupled to the holder 120.

Figure 9:
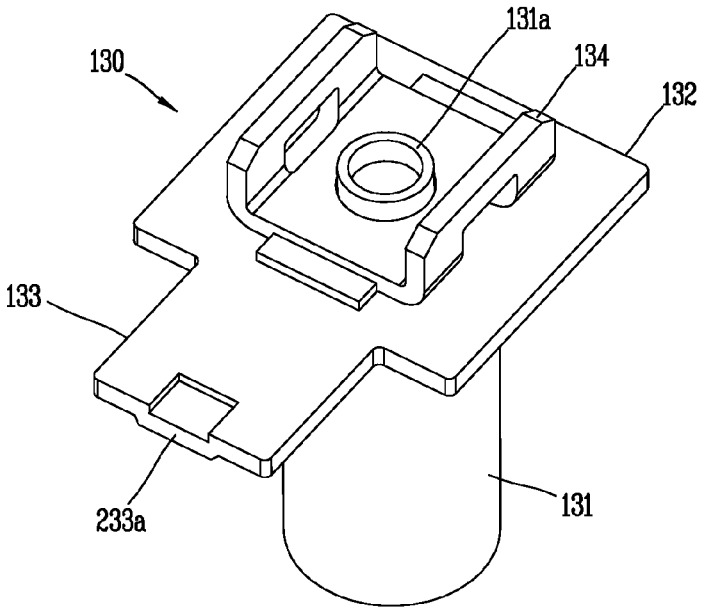
FIG. 9 is a perspective view of a movable core according to a second embodiment of the present invention.

FIG. 9 is a perspective view of a movable core according to a second embodiment of the present invention.

A switch manipulation projection 233*a* having an embossed shape may be formed at a switch manipulation part 133 of a movable core 130 illustrated in FIG. 9, and may protrude toward a contact terminal 172*a*' of a b-contact switch 172, thereby closely maintaining a mechanical mechanism relationship between the movable core 130 and the b-contact switch 172.

Figure 10:
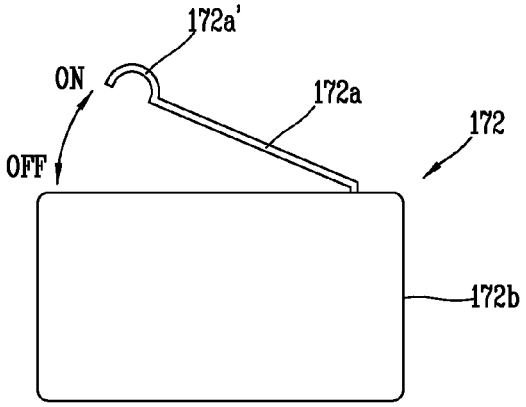
FIG. 10 is a side view of a b-contact switch according to an embodiment of the present invention.

FIG. 10 is a side view of a b-contact switch 172 according to an embodiment of the present invention.

The b-contact switch 172 illustrated in FIG. 10 may include a switch body 172*b* having a tetragonal box structure and a switch operation lever 172*a* which is mounted on an upper end of the switch body 172*b*.

The switch body 172*b* may include a movable contact 123 and a fixed contact 113 which are provided in the switch body 172*b*, and the movable contact 123 may be separated from or may contact the fixed contact 113 according to an operation of the switch operation lever 172*a*. In this case, the movable contact 123 may be adhered to one side of the switch body 172*b* so as to surface-contact an upper end of the PCB 171 of the electronic circuit part 170.

The switch operation lever 172*a* may have a rectangular plate structure which is long in length and is thin in thickness. One end of the switch operation lever 172*a* is coupled in a hinge structure, and the other end of the switch operation lever 172*a* may be pressed by a switch manipulation projection 133*a*, and when the press is released, the switch operation lever 172*a* may be restored to the original position by an elastic restoring force of the switch operation lever 172*a* itself.

In this case, a contact terminal 17*a*' having an arc shape may be provided at the other end of the switch operation lever 172*a*, and thus, a contact with the switch manipulation projection 133*a* is smoothly maintained.

Moreover, a contact of the b-contact switch 172 normally is in a switch-on state, and when the switch operation lever 172*a* is pressed, the contact of the b-contact switch 172 is inverted into a switch-off state.

Figure 11:
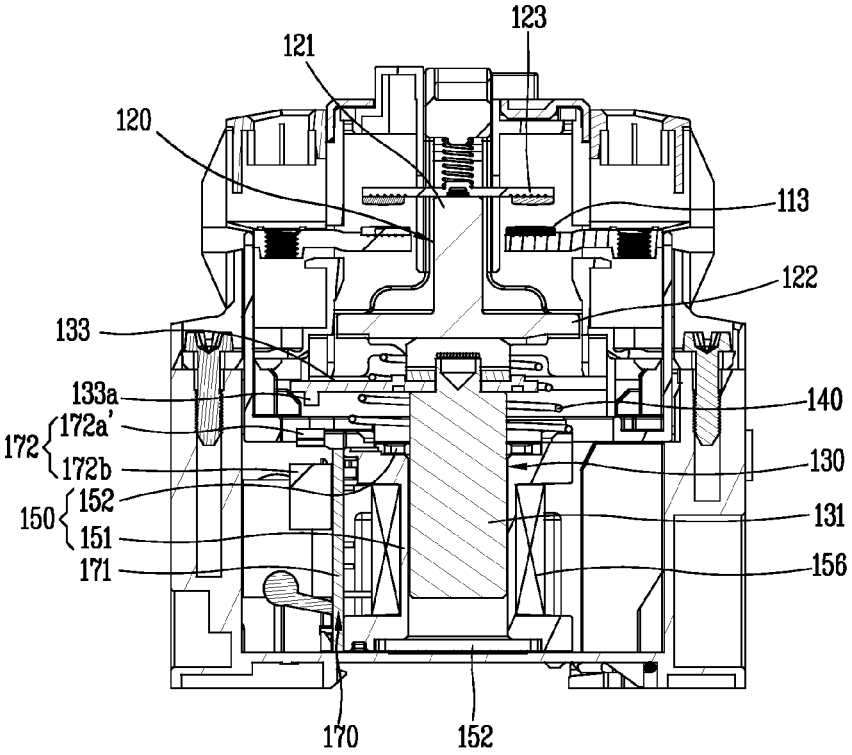
FIG. 11 is a cross-sectional view of a magnetic contactor according to an embodiment of the present invention.

FIG. 11 is a cross-sectional view of a magnetic contactor according to an embodiment of the present invention.

An operating state of the magnetic contactor will now be described in detail with reference to FIG. 11.

When an external source current is applied to a coil 156, a magnetic field is generated around the coil 156, and a bobbin 150 and a fixed core 160 are magnetized by the magnetic field. A magnetic force is generated in the magnetized bobbin 150 and fixed core 160, and a movable core 130 is absorbed into the fixed core 160 by the magnetic force.

Subsequently, due to the external source current, a movable contact 123 of an electronic circuit part 170 is moved to and contacts the fixed contact 113, and thus, a circuit is connected, whereby main power flows in a load.

At this time, a switch manipulation projection 133*a* of a switch manipulation body 132 coupled to an upper end of the movable core 130 presses a contact terminal 172*a*' of a switch operation lever 172*a* of a b-contact switch 172, and thus, the b-contact switch 172 is switched off. Simultaneously, the external source current is dropped by passing through a capacitor 173 of the electronic circuit part 170, and the dropped external source current flows to the coil 156, thereby maintaining a contact between the movable contact 123 and the fixed contact 113.

When the external source current dissipates, the magnetic field of the coil 156 dissipates, and an absorbing force of the fixed core 160 is released. Therefore, the movable core 130 is pushed up to the original position by an elastic restoring force of an elastic member 140 which is disposed between the holder 120 and the bobbin 150, and thus, the movable contact 123 is separated from the fixed contact 113, whereby the main power is cut off.

Therefore, according to an embodiment of the present invention, a disposed position of the b-contact switch 172 is changed to a lower portion of a product in comparison with the existing product, and thus, the product can be miniaturized. Also, a position of the b-contact switch 172 is changed, and thus, the switch manipulation part 133 is provided at a movable part, thereby realizing an operation of the b-contact switch 172.

As described above, in the magnetic contactor according to an embodiment of the present invention, the b-contact switch is disposed at a lower portion of a product, and thus, the product is miniaturized. Also, even without enlarging a size of the product, an operation of the b-contact switch is realized by using the switch manipulation member which is provided in the movable core.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A magnetic contactor comprising:

a frame configured to include a fixed contact;

a holder movably provided in the frame, and configured to include a movable contact which is contactable with the fixed contact;

a movable core coupled to the holder to interoperate with the holder;

a bobbin fixed to and provided in the frame, and configured to include a coil;

a fixed core coupled to a side of the bobbin, and configured to absorb the movable core with a magnetic force;

an elastic member provided between the holder and the bobbin;

a b-contact switch configured to sense a closing completion time of the movable contact by using a mechanical mechanism relationship with the movable core;

an electronic circuit part configured to receive a sensing signal from the b-contact switch and limit a current applied to the coil; and a switch manipulation member provided at one end of the movable core, and configured to operate the b-contact switch, wherein the electronic circuit part is provided at a width-direction side of the bobbin in parallel with a moving direction of the movable core, and the b-contact switch is disposed at an end of one side of the electronic circuit part and on a moving line of the switch manipulation member.

2. The magnetic contactor of claim 1, wherein, the frame comprises:

a first frame configured to accommodate the holder; and a second frame adjacently assembled with the first frame, and configured to include the bobbin and the fixed core, and the b-contact switch is contactably disposed within a moving distance range of the switch manipulation member and in the second frame.

3. The magnetic contactor of claim 1, wherein the switch manipulation member comprises:

a switch manipulation body;

a switch manipulation part provided to protrude at an end of one side of the switch manipulation body, and disposed to be separated from the b-contact switch with an interval in a moving direction of the movable core; and a switch manipulation projection formed at the switch manipulation part to protrude toward the b-contact switch.

4. The magnetic contactor of claim 3, wherein the switch manipulation projection is formed in an embossed shaped at an end of the switch manipulation part.

5. The magnetic contactor of claim 1, wherein, the holder comprises a coupling part provided at one end of the holder, and the movable core comprises:

a support provided at the switch manipulation part, and configured to include an inserting hole at each of both sides of the support; and a supporting pin inserted into the inserting hole to pass through the inserting hole, wherein both ends of the supporting pin are inserted into and coupled to the coupling part of the holder to connect the holder to the support.

6. The magnetic contactor of claim 1, wherein, the holder comprises a guide groove formed at one end of the holder, and the movable core comprises a support provided at the switch manipulation part, and configured to include a sliding projection which is formed at each of both ends of the support, wherein the support is inserted into and coupled to the guide groove of the holder.

7. The magnetic contactor of claim 1, wherein the b-contact switch comprises:

a switch body configured to include a movable contact and a fixed contact; and a switch operation member provided at one end of the switch body, wherein the switch operation member is pressurized by the switch manipulation member, and simultaneously switches off the movable contact and the fixed contact.

8. The magnetic contactor of claim 7, wherein the switch operation member has a strip type in which a length is longer than a width, is provided at one end of the switch body to be inclined in a hinge structure, and has elasticity.

9. The magnetic contactor of claim 7, wherein a contact terminal having an arc shape is provided at an end of the switch operation member.

* * * * *